United States Patent [19]

Perälä

[11] Patent Number: 4,939,344

[45] Date of Patent: Jul. 3, 1990

[54] ELECTRIC SAUNA OVEN WITH SHIELD FOR TRANSMITTING HEAT RADIATION TO DETECTOR

[75] Inventor: Reijo Perälä, Hangonkylä, Finland

[73] Assignee: Oy Helo-Tehtaat, Hanko, Finland

[21] Appl. No.: 265,360

[22] Filed: Oct. 25, 1988

Related U.S. Application Data

[63] Continuation of Ser. No. 913,937, Oct. 1, 1986, abandoned.

[30] Foreign Application Priority Data

Oct. 3, 1985 [FI] Finland ..... 853841

[51] Int. Cl.[5] ..... H05B 3/02

[52] U.S. Cl. ..... 219/364; 219/365; 219/276

[58] Field of Search ..... 219/364, 365, 370, 502, 219/366, 367, 271–276, 362, 531, 379; 4/524

[56] References Cited

U.S. PATENT DOCUMENTS

| | | | |
|---|---|---|---|
| 3,111,573 | 11/1963 | Crowe et al. | 219/370 |
| 3,147,367 | 9/1964 | Magnusson | 219/370 X |
| 3,275,800 | 9/1966 | Kuoppamaki et al. | 219/365 |
| 3,277,274 | 10/1966 | Raabe | 219/365 X |
| 3,309,501 | 3/1967 | Jansson | 219/365 X |
| 3,337,715 | 8/1967 | Finn | 219/365 X |
| 3,348,021 | 10/1967 | Skogland | 219/365 X |
| 3,400,248 | 9/1968 | Isomaa | 219/365 X |
| 3,530,277 | 9/1970 | Kujansuu | 219/367 X |
| 3,531,623 | 9/1970 | Teeri | 219/367 |
| 3,739,144 | 6/1973 | Janson | 219/365 X |
| 3,769,494 | 10/1973 | Janson | 219/364 X |
| 3,892,946 | 7/1975 | Rimmi | 219/365 X |
| 4,034,204 | 7/1977 | Windsor et al. | 219/365 X |
| 4,045,652 | 8/1977 | Janson | 219/364 X |
| 4,149,065 | 4/1979 | Goff et al. | 219/365 |
| 4,375,590 | 3/1983 | Janson | 219/364 |
| 4,384,190 | 5/1983 | Janson | 219/365 |
| 4,593,176 | 6/1986 | Seefeldt | 219/365 |

FOREIGN PATENT DOCUMENTS

| | | |
|---|---|---|
| 50930 | 5/1971 | Finland . |
| 66532 | 6/1982 | Finland . |

*Primary Examiner*—William M. Shoop, Jr.
*Assistant Examiner*—A. Jonathan Wysocki
*Attorney, Agent, or Firm*—Michael N. Meller

[57] ABSTRACT

An electric sauna oven comprises one or more electric resistors (4) for heating the oven, a current source (7) for supplying electric current to the resistors, a thermostat and a temperature limiter (8) for controlling the supply of current to the resistors. To avoid problems caused by the control of an electric sauna oven on the basis of the temperature of the air contained in the sauna room, at least the thermostat of the current supply control operates on the basis of the heat radiation emitted by the heating resistors. A radiation shield (5, 9) is provided between the detecting element of the thermostat and the heating resistors for the transmission of heat radiation from the resistors to the detecting element.

7 Claims, 1 Drawing Sheet

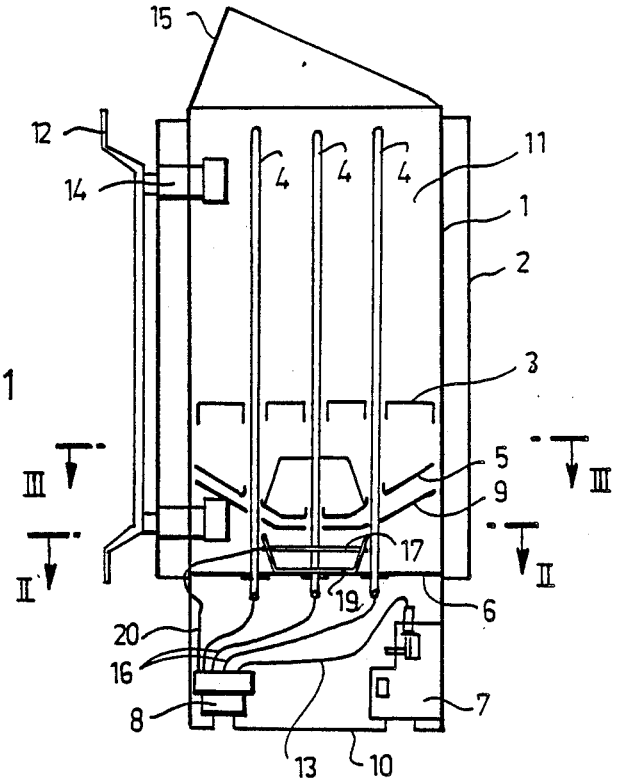
FIG. 1
FIG. 2
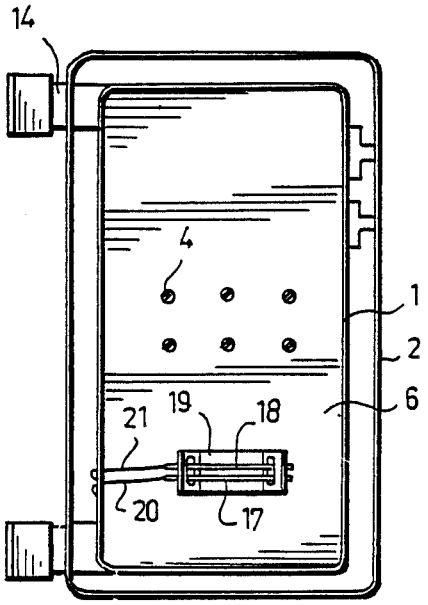
FIG. 3
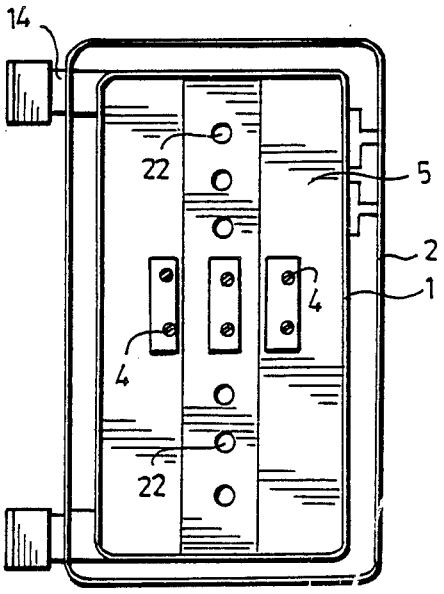

ELECTRIC SAUNA OVEN WITH SHIELD FOR TRANSMITTING HEAT RADIATION TO DETECTOR

This is a continuation of Ser. No. 913,937, filed Oct. 1, 1986, now abandoned.

BACKGROUND OF THE INVENTION

The invention relates to an electric sauna oven comprising at least one electric resistor for heating the oven, means for supplying current to said at least one electric resistor, and thermostatic means and temperature limiting means for controlling the supply of current to said at least one resistor.

For some years it was customary to position the detecting means of the thermostat and the temperature limiter of an electric sauna oven on the wall of the sauna at a suitable height to directly measure the temperature in the sauna room. A more recent tendency has been to get rid of this way of installation because it requires rather long wirings when installing the oven. At present the detecting means of the thermostat and temperature limiter are in most cases installed within the outer jacket of the oven to measure the temperature of the air streaming between the jackets. Thus the installation can be completed at the factory. Since it is the temperature of the air streaming between the jackets of the oven that is to be measured, attempts have been made to separate the detecting means from the other structures of the oven to the extent possible. This has been effected firstly by arranging a reflector, such as an aluminum film, on the inner surface of the stone space beside the detecting means in order to reflect thermal radiation away therefrom. Secondly, the detecting means have been placed on a fairly light holder so that the heat transferred from the jackets through conduction would not affect the detecting means.

In other words, the operation of traditional electric sauna ovens has been tried to be controlled on the basis of the temperature of the air contained in the steam room. This, however, has led to an obvious risk of the ceiling structures of the sauna room being overheated, particularly during the initial heating of the oven. For example, if the set value of the thermostat is about 120° C., then the temperature of the ceiling structures will exceed the allowed value, i.e. 140° C., during the initial heating. As a result of this, it has been necessary to limit the temperatures of the sauna room in order to prevent the overheating of the ceiling structures. The slowness of the adjustment based on the measurements of the temperature of air can be regarded as a major reason for this overheating. On the other hand, the overheating of the ceiling structures has been tried to be avoided by the use of oven structures in which the amount of the air flowing therethrough has been as large as possible. Consequently, the temperature of the oven stones might drop very near the temperature of the steam room at the beginning of the sauna bath if the oven has been left waiting for some time after the initial heating thereof, and this has considerably decreased the steam generating capacity of the stones.

SUMMARY OF THE INVENTION

The object of the present invention is to provide a new electric sauna oven by means of which the above-mentioned problems can be essentially avoided. This has been achieved in the electric sauna oven according to the invention by arranging at least the thermostat of the control means of the current supply to operate primarily on the basis of the heat radiation emitted from the heating resistors. Accordingly, or a radiation shield is provided between the detecting element of the thermostat and the heating resistors for transmitting the heat radiation from the resistors to the detecting element. It is preferable to use a radiation shield positioned between the resistors and the detecting element if conventional detecting elements presently in use in electric sauna ovens are used as the range of operation thereof is limited to about 160° C. The radiation shield thereby preferably comprises two plate-like parts, whereby one of them is integral and the other is provided with openings in order to allow passage for a suitable amount of radiation from the resistors to the detecting element of the thermostat. It is possible to use one and the same detecting element at the same position in connection with sauna ovens of different wattages by varying the shape, size and positioning of the openings.

In order to eliminate any influence of the temperature of the air contained in the sauna room, it is of advantage that the detecting element of the thermostat be positioned in a space below the heating resistors within the jacket of the sauna oven. Furthermore, it is advantageous that the detecting element be placed on a holder in order to minimize the amount of heat transferred through conduction from the frame structure of the oven to the detecting element.

Even though it is possible to use conventional positionings and structures of the detecting element of the temperature limiter in connection with the sauna oven according to the invention, the operation of the temperature limiter can be made very rapid and reliable by placing the detecting element thereof in a manner similar to the detecting element of the thermostat and preferably on the same holder therewith.

BRIEF DESCRIPTION OF THE DRAWINGS

The electric sauna oven according to the invention and the advantages offered thereby will be described more closely below with reference to the attached drawing, wherein FIG. 1 is a cross-sectional side view of an electric sauna oven according to the invention, FIG. 2 is a sectional view of the oven of FIG. 1 taken along the line II—II shown in FIG. 1, and FIG. 3 is a sectional view of the oven of FIG. 1 taken along the line III—III shown in FIG. 1.

PREFERRED EMBODIMENT OF THE INVENTION

The electric sauna oven shown in FIG. 1 comprises a frame structure 1 within which heating resistors 4 are positioned. A stone space 11 is formed at the upper portion of the oven around the heating resistors 4, the bottom of said space being formed by a grate 3 which is adjustable at different heights as required. The resistors 4 pass through the grate through openings formed therein. An outer jacket 2 is formed around the frame structure 1 in such a manner that a flow passage is provided for the air between the jackets 1 and 2. This is vital in order to keep the temperature of the outer jacket of the oven sufficiently low. The sauna oven shown in FIG. 1 is intended to be hung on a wall, wherefore it is provided with supports 14 which are engaged with a carrier 12 to be fastened to the wall. The control unit of the oven is positioned at the lower portion of the oven, which unit comprises an upper bottom surface 6 and a lower bottom surface 10, and current supply means 7 positioned in a casing formed between said surfaces. The current supply means 7 usually comprises, for example, a main switch, a timer, and thermostat and temperature limiting means 8. The heating resistors 4 are supplied from the current supply means 7 through a conductor 13 to the thermostat and temperature limiting means and further to the resistors 4 through the conductors 16.

In the electric oven according to the invention the detecting elements 17 and 18 of the thermostat and temperature limiting means are positioned on a holder 19 secured to the upper surface of a cover 6 of the control unit. In the embodiment of FIG. 1, detecting elements 17 and 18 are respectively capillary tube thermostat and a capillary tube limiter which are connected to the thermostat and temperature limiting means by means of capillary tubes 20 and 21. It is also possible to use temperature detecting means of some other type, such as NTC resistors.

In order to enable the use of temperature detecting means of the types most usually used in sauna ovens, i.e. those having the maximum operating temperature of about 160° C., a protection shield is provided between the heating resistors 4 and the detecting elements 17 and 18, which shield in the embodiment of FIG. 1 is formed by two plate-like parts 5 and 9. These structural parts prevent a direct transfer of the radiation heat of the heating resistors to the detecting elements in order to limit the temperature detected by the detecting elements within a range suitable for the operation thereof. Consequently, it is to be understood that no radiation shield is needed if another kind of commercially available detecting means operative at higher temperatures are used. The only essential thing is that some naked part of the heating resistor be in radiational coupling with the detecting element through a radiation shield transmitting the heat radiation. Thus the detecting element can be most advantageously positioned in a space between the grate 3 of the oven and the cover 6 of the control unit.

The structure of the detecting elements and the protection shield according to the specific embodiment shown in FIG. 1 can be described in more detail with reference to FIGS. 2 and 3. FIG. 2 shows that the holder 19 of the detecting elements 17 and 18 is secured on the cover 6 of the control box, and that the capillary tubes 20 and 21 run around the edge of the cover 6 to the control box. The structure of the holder 19 of the detecting elements 17 and 18 is such that the amount of heat transferred by conduction to the detecting elements from the cover 6 through the holder 19 can be minimized. In addition, the detecting elements 17 and 18 are positioned so that the air flowing between the jackets 1 and 2 of the oven, which air can be occasionally cool, cannot affect the detecting elements. In fact, the detecting elements are responsive only to the heat radiation from the heating resistors. This effect is further emphasized by the positioning of the detecting elements below the heating resistors.

FIG. 3 shows the structure of the upper plate-like part 5 of the radiation shield according to the invention. The lower plate-like part 9, which is shown in FIG. 1, is integral and acts as a surface transmitting heat radiation and, moreover, prevents the possibility of stone pieces falling from the stone space from contacting the detecting elements 17 and 18. The upper plate-like part 5 of the radiation shield is provided with openings 22 which are positioned above the detecting elements 17 and 18 and through which the radiation is transmitted from the naked parts of the heating resistors 4 directly to the lower plate-like part 9 of the radiation shield, which part transmits it further to the detecting elements 17 and 18. It is to be understood that the amount of radiation transmitted can be adjusted to a suitable level by varying the size and shape of the openings 22. It is thus possible to use similar detecting elements 17 and 18 and the same kind of installation thereof in connection with ovens of different wattages by varying the shape and positioning of the openings of the upper plate 5 of the radiation shield. Of course, it is also possible to position the plates 5 and 9 in reversed order so that the upper plate is integral and the lower one is provided with openings. Thereby it is naturally necessary that the shape, size and/or position of the openings be such that the desired amount of radiation reaches the detecting elements.

The sauna oven according to the invention does not rest on the idea of observing the temperature of the air contained in the steam room by means of the detecting elements. Instead, the surface temperature of the heating resistors and particularly the heat radiation emitted thereby are observed. This heat radiation is extremely well suited as a measuring parameter of the surface temperature of the heating resistors, because the amount of heat radiation is proportional to the square of the surface temperature. Consequently, even a slight change in the surface temperature effects a major change in the amount of radiation. Because it is only the temperature of the heating resistors that is observed in the electric sauna oven according to the invention, the adjustment obtained is considerably more rapid and accurate than previously. As a result thereof, the heating peaks occurring, particularly in connection with the initial heating of the sauna oven, can be avoided and, on the other hand, the temperature of the oven stones can be maintained at a desired level irrespective of whether the oven is loaded or not. Thus the temperature of the oven stones does not drop even if the oven is kept waiting without use for a longer time. Thus it is also possible to decrease the amount of air flowing through the oven because excessively high temperatures on the ceiling surfaces of the steam room are automatically avoided by keeping the heating resistors of the oven at an appropriate temperature. It has been found in practical measurements that the temperature of the sauna can be raised up to 120° C. without any risk of the temperature limit set for the ceiling surface (140° C.) being exceeded. This is mainly due to the rapid adjustment used in the oven according to the invention, on account whereof the overheating of the resistors is avoided, as is the transmission of large amounts of heat to the surfaces of the sauna room.

The invention has been described in the attached drawings only on the basis of one specific embodiment, and it is to be understood, as already mentioned, that the operation essential to the invention, i.e. the control of the electric sauna oven on the basis of the surface temperature of the heating resistors, can be carried out by means of structures and detecting means of quite a different type without, however, deviating from the scope of protection defined in the attached claims.

I claim:

1. An electric sauna oven comprising a stone space, at least one electric resistor arranged in said stone space for heating the oven, a jacket for encasing said stone space and said at least one electric resistor, means for supplying current to said at least one electric resistor, means for detecting heat radiation from said at least one electric resistor, means for holding said detecting means, said holding means having a structure which minimizes heat energy transfer by thermal conduction to said detecting means and being arranged beneath said stone space and within said jacket, a means for transmitting to said detecting means heat radiation received from said at least one electric resistor, said transmitting means being arranged between said at least one electric resistor and said detecting means, and thermostatic means coupled to said detecting means for controlling the supply of current to said at least one electric resistor, said thermostatic means controlling the supply of current as a function of only the heat radiation emitted by said at least one electric resistor and detected by said detecting means, wherein said transmitting means comprises first and second plate-like parts arranged at upper and lower levels respectively between said at least one electric resistor and said detecting means.

2. The electric sauna oven as defined in claim 1, further comprising temperature limiting means coupled to said detecting means for cutting off the supply of current to said at least one electric resistor.

3. The electric sauna oven as defined in claim 2, wherein said radiation shielding means comprises first and second plate-like parts arranged at upper and lower levels respectively between said at least one electric resistor and said detecting means.

4. The electric sauna oven as defined in claim 1, wherein said first plate-like part is closer to said at least one electric resistor than is said second plate-like part and said second plate-like part is closer to said detecting means than is said first plate-like part, said first plate-like part being provided with openings which are located to allow passage of radiation from said at least one electric resistor to said second plate-like part.

5. The electric sauna oven as defined in claim 3, wherein said first plate-like part is closer to said at least one electric resistor than is said second plate-like part and said second plate-like part is closer to said detecting means than is said first plate-like part, said first plate-like part being provided with openings which are located to allow passage of radiation from said at least one electric resistor to said second plate-like part.

6. The electric sauna oven as defined in claim 4, wherein said second plate-like part is not provided with openings.

7. The electric sauna oven as defined in claim 5, wherein said second plate-like part is not provided with openings.

* * * * *